United States Patent [19]

Froese et al.

[11] Patent Number: 4,848,421

[45] Date of Patent: Jul. 18, 1989

[54] POUCH FILLING APPARATUS HAVING DUCK BILL SPOUT

[75] Inventors: Richard J. Froese; Mark A. Leonhardt, both of Cincinnati, Ohio; Michael J. Roy, Villa Hills, Ky.

[73] Assignee: R. A. Jones & Co. Inc., Covington, Ky.

[21] Appl. No.: 182,179

[22] Filed: Apr. 15, 1988

[51] Int. Cl.[4] ..... B65B 3/16

[52] U.S. Cl. ..... 141/114; 141/144; 141/147; 141/166; 141/177; 141/181; 141/313; 53/384

[58] Field of Search ..... 141/114, 10, 129, 144, 141/145, 146, 147, 152, 177, 165, 166, 181, 313, 98; 53/455, 457, 459, 492, 381 R, 384

[56] References Cited

U.S. PATENT DOCUMENTS

| | | | |
|---|---|---|---|
| 2,780,901 | 2/1957 | Youngblood | 53/384 |
| 2,920,794 | 1/1960 | Bauder et al. | 141/147 X |
| 2,973,612 | 3/1961 | McGowan | 141/166 X |
| 3,554,412 | 1/1971 | Hayashi et al. | 141/144 X |
| 3,712,019 | 1/1973 | Lamka et al. | 53/459 |
| 3,750,721 | 8/1973 | Hudson | 141/10 |
| 3,949,536 | 4/1976 | Chevalier | 53/384 X |
| 4,526,214 | 7/1985 | McGregor | 141/114 X |
| 4,586,319 | 5/1986 | Ausnit | 53/384 X |
| 4,702,289 | 10/1987 | Benner, Jr. et al. | 141/125 |

FOREIGN PATENT DOCUMENTS

| | | | |
|---|---|---|---|
| 2003200 | 7/1971 | Fed. Rep. of Germany | 53/384 |
| 690215 | 4/1953 | United Kingdom | 141/147 |

*Primary Examiner*—Ernest G. Cusick

*Attorney, Agent, or Firm*—Wood, Herron & Evans

[57] ABSTRACT

Pouch filling apparatus having a horizontal rotatable drum, an inclined spout plate rotatably mounted above the drum and a metering wheel mounted above the spout plate. A plurality of duck bill spouts are mounted on the spout plate and a plurality of cams are mounted on the drum. The duck bill spouts carry cam followers that engage the cams as the inclined spout plate moves the spouts downwardly with respect to the drum that carries the cams.

6 Claims, 4 Drawing Sheets

POUCH FILLING APPARATUS HAVING DUCK BILL SPOUT

BACKGROUND OF THE INVENTION

This invention relates to pouch filling apparatus, and more particularly the invention relates to the spout that enters the pouch and through which product flows during the filling operation.

In the pouch form, fill, seal machine to which the present invention is directed, a web is folded upon itself longitudinally and is transversely sealed at spaced intervals to form pouches between the seals. That transversely-sealed web is fed to a filling apparatus. At the filling apparatus, the web is passed around a horizontal drum having spaced vertical lands on which the seals are positioned. The spacing of the lands with respect to the pouches is such that the pouches are opened slightly as they are positioned on the lands. Suction cups behind each pouch may be provided to assist in the opening.

Above the horizontal drum is an inclined spout plate that rotates with the drum. The spout plate carries spouts that gradually move downwardly during their excursion until they move into the open pouches. Above the pouch plate is an inclined metering wheel that measures a charge of product and, when the spout has entered the pouch, releases the measured charge to enable the product to flow into the pouch by gravity.

A spout whose discharge opening is of a fixed size is generally satisfactory for large pouches and small particles. For pouches having small openings and large particles, a problem is presented by a fixed size spout. Typical among such pouches are vending machine pouches that are long and narrow and which are filled with peanuts, coated candies and the like.

The large particles require a large opening to avoid the jamming of the particles as a charge of product attempts to flow through the spout into the pouch. But a spout having a large discharge opening will not pass reliably into a pouch as the spout is carried in a descending path by the inclined pouch plate into the pouch.

SUMMARY OF THE INVENTION

It has been an objective of the present invention to provide a spout having a small discharge opening as it moves into the opened end of the pouch and which is thereafter expanded so as to facilitate the flow of product through the spout into the pouch.

This objective of the invention is attained, in part, by providing a duck bill spout on the spout plate. A duck bill spout has two jaws that are pivoted together intermediate their upper and lower ends. In the pouch-entering position, the jaws, at the lower end, are close together so as to present a small spout for entry into the pouch. After the spout has entered the pouch, the jaws are pivoted with respect to each other to open up the discharge opening to facilitate flow of product into the pouch.

The manipulation of the spout jaws is accomplished by providing a small cam mounted on the horizontal drum opposite each spout. Since the cams are on the horizontal drum, the spouts, mounted on the inclined plate, will move downwardly and outwardly with respect to the horizontal drum. The inner jaw of the duck bill spout carries a cam follower which engages the cam to cause the jaws to open and stay open as the spout lowers itself into the pouch.

It is another feature of the invention to provide the cam with a compound surface that accommodates the downward movement of the cam follower, the outward movement of the cam follower, and the requirement that the jaws open and then stay in an open position until the filling is accomplished.

Each cam, in accordance with the present invention, is a generally frusto-conical element that is mounted on a post, the post in turn being mounted on the drum. The frusto-conical element can be easily machined from circular stock because it is circular in cross section. When worn, it can be rotated slightly (5°) to bring up a new line of contact for the cam follower. Further, when completely worn, the element is easily replaced. Because of the ability to accommodate wear, it is contemplated that the cam element will be a plastic material so as to minimize the noise created by the engagement of the cam follower with the cams. This is particularly important since the machines of the present invention fill pouches at the rate of up to 1,000 a minute requiring around 30 engagements of cam with cam follower every minute depending upon the number of spouts on the wheel, thirty-six for example.

BRIEF DESCRIPTION OF THE INVENTION

The several objectives and features of the invention will become more readily apparent from the following detailed description taken in conjunction with the accompanying drawings in which.

DESCRIPTION OF THE PREFERRED EMBODIMENT

Figure 1:
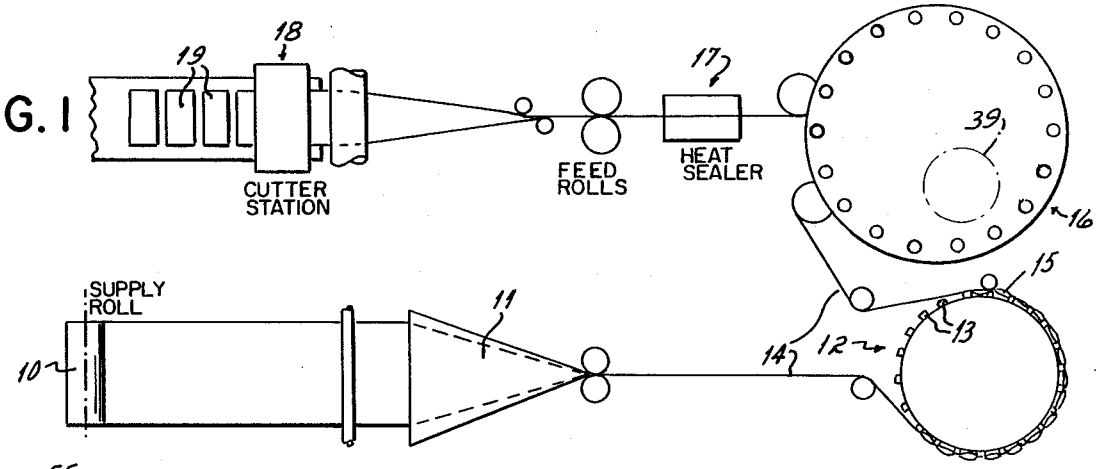
FIG. 1 is a diagrammatic plan view of the pouch form, fill, seal machine to which the present invention is applied.
Figure 4:
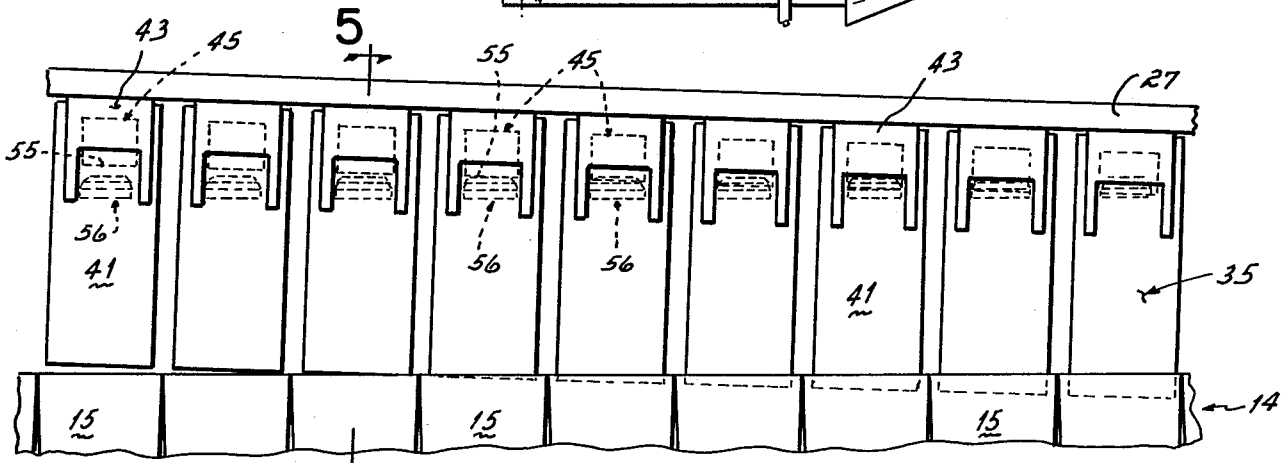
FIG. 4 is a developed diagrammatic view taken generally along lines 4—4 of FIG. 2.

A pouch form, fill, seal machine of the type to which the present invention is directed is shown in FIG. 1. A supply roll of film or foil is shown at 10. It passes over a plow 11 where it is folded upon itself. The thus-folded film is passed around a vertical sealer 12 which is a drum having a plurality of hot lands 13 which apply vertical seals to the folded web 14, thereby forming individual pouches 15. The web is then passed around a filling station 16 which is provided with means for opening the pouches to permit them to be filled. Above the pouches is a filling mechanism which will be described in greater detail hereafter which discharges measured charges of product into the individual pouches while they are in interconnected web form.

After being filled at the filling station 16, the web is passed through a heat sealer 17 which forms a seal across the open ends of the pouches in the webs. Thereafter, the web is turned to a horizontal attitude and passed through cutting knives at a cutter station 18 to cut the web into individual pouches 19. The mechanism as thus far described is old and can be more fully understood by reference to U. S. Pat. No. 3,597,898, for example.

Figure 2:
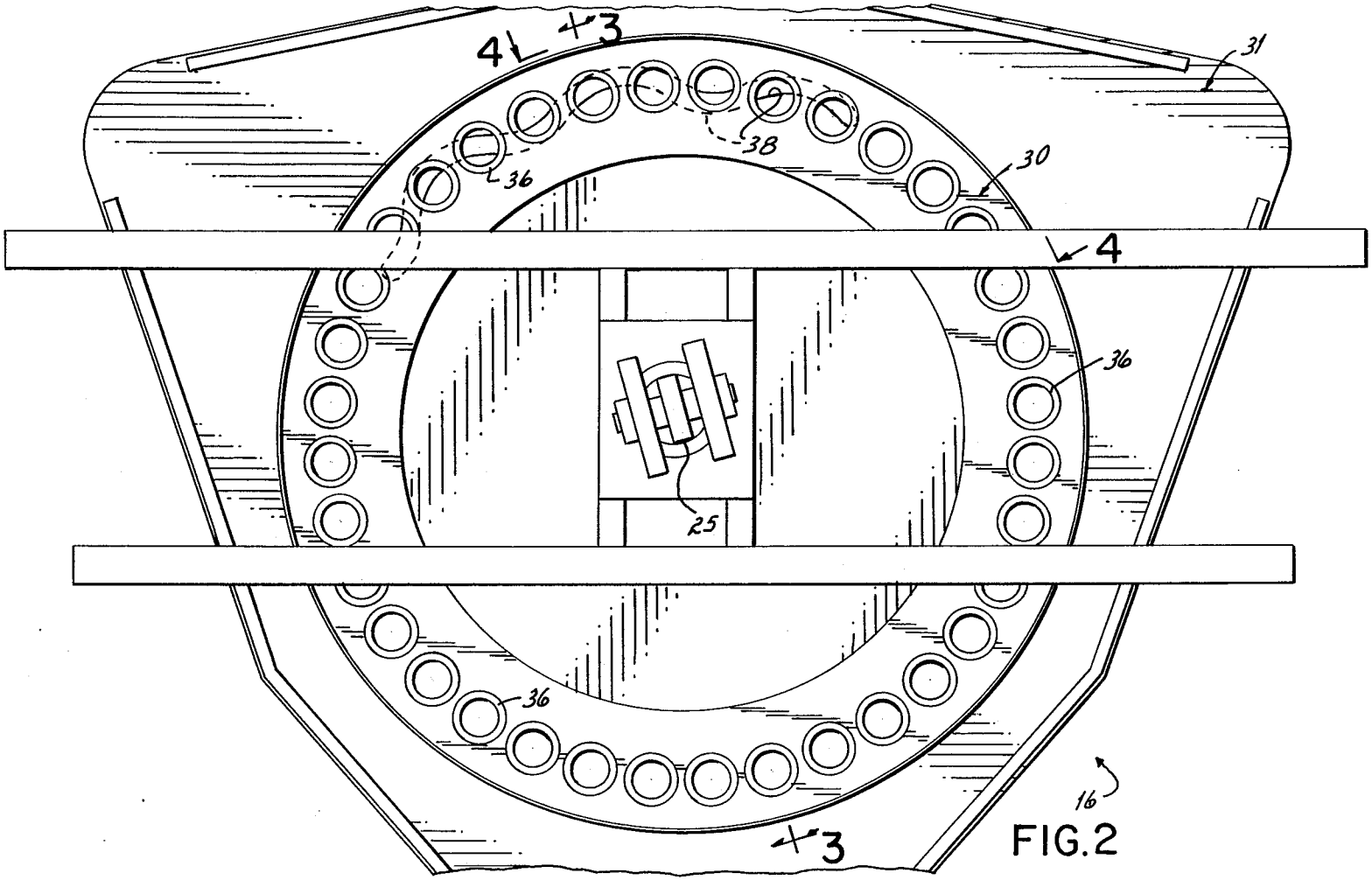
FIG. 2 is a top plan view of the filling apparatus.
Figure 3:
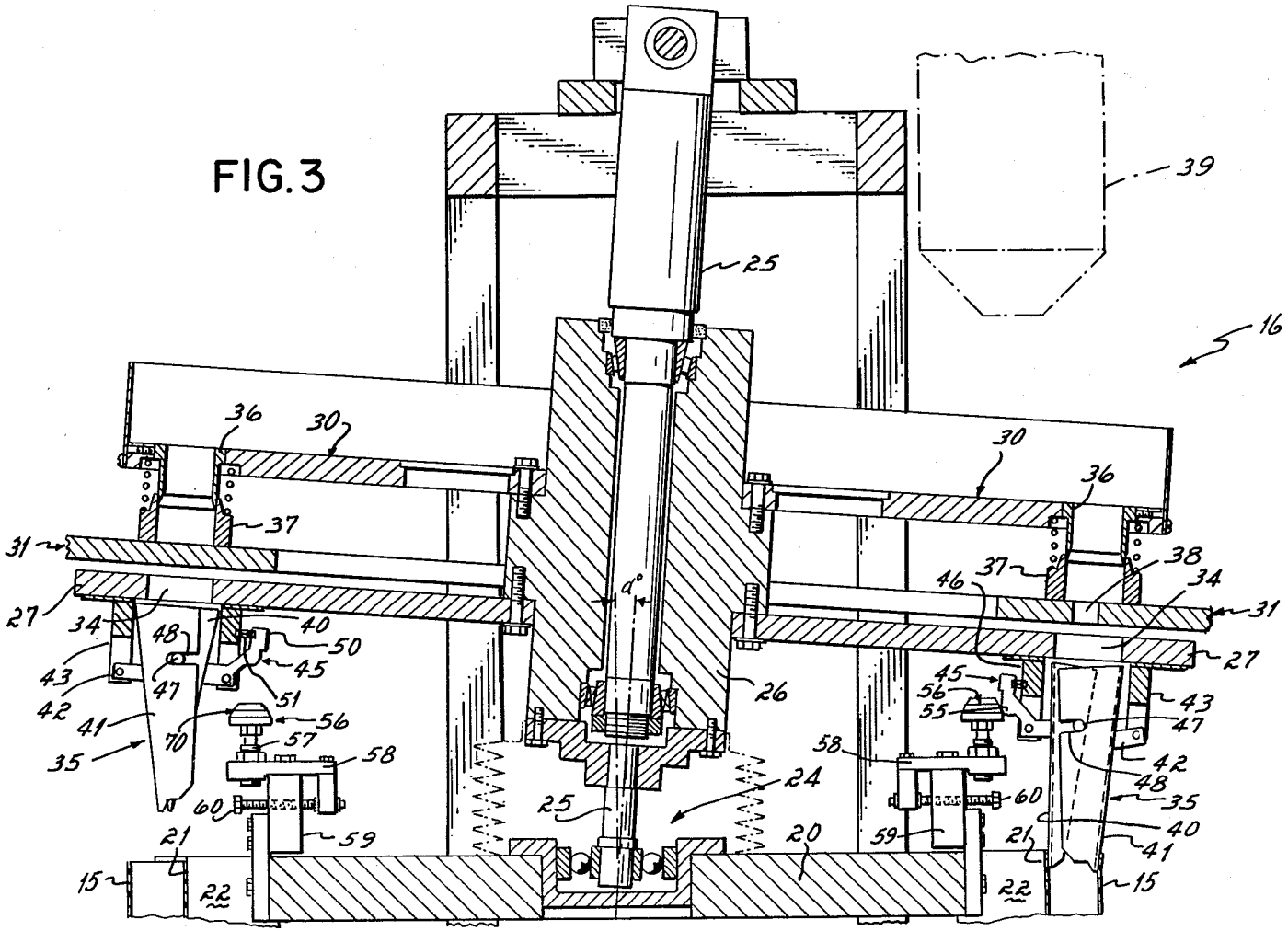
FIG. 3 is a cross-sectional view taken along lines 3—3 of FIG. 2.

Referring now to FIGS. 2 and 3, a rotating drum 20 has a plurality of spaced lands 21 that define compartments 22 between the lands. The web 14 passes around the drum and forms individual pouches 15.

The drum drives an inclined shaft 25 through a constant velocity joint 24. The shaft 25 is bolted to an inclined sleeve 26. The sleeve 26 carries a spout plate 27 and a metering wheel 30. A stationary plate 31 is mounted between the spout plate and the metering wheel. In the illustrated embodiment, the spout plate is about twenty-eight inches in diameter and is inclined to horizontal by about 4°. It has a plurality of filling holes 34 each aligned with a pouch compartment 22. It carries a plurality of spouts 35 which are movable in a vertical direction about one and a half inches because of the inclination of the spout plate and its twenty-eight inch diameter.

The metering wheel has a plurality of cups 36, each being aligned with a respective spout 35. A spring-loaded slidable cuff 37 forms a contact for the cup 36 onto the stationary plate 31. The plate 31 has a sinuous slot 38 that extends through a limited arc around the stationary plate, the slot 38 forming the trap door by which the product that is contained in the cup 36 is discharged into the spout 35.

Product is introduced into a hopper 39 which discharges onto the metering wheel 30 and is guided into the respective cups 36 by blades, brushes and the like.

Each spout 35 is a duck bill form of spout having an inner jaw 40 and an outer jaw 41. Each jaw is channel-shaped with the inner jaw telescoping within the outer jaw 41. The outer jaw 41 is fixed to a block 42 which in turn is pivoted between the depending legs of an inverted U-shaped bracket 43, the bracket being mounted on the spout plate 27.

The inner jaw 40 is fixed to a bell crank lever 45, the bell crank lever being pivoted between depending legs of an inverted U-shaped bracket 46.

The inner jaw 40 carries a roller 47 on each side, each roller riding in a slot 48 on the adjacent wall of the outer jaw. Thus, the roller coordinates the movement of the two jaws causing them to swing together as the bell crank lever 45 on inner jaw 40 is pivoted about an axis 49.

The bell crank lever 45 has an end 50 which is connected by a compression spring 51 to the U-shaped bracket 46 causing the bell crank lever to pivot away from the bracket. The bell crank lever carries a cam follower surface 55. That surface cooperates with a cam 56 mounted on a threaded vertically-adjustable post 57. The post 57 is mounted on a bracket 58 which is slidably mounted on a block 59 which is fixed to drum 20. A screw 60 threaded in the block 59 is rotatably mounted in the bracket 58 so that as it is rotated it can move the cam 56 radially in and out. By horizontally moving the position of the cam 56 through movement of the block 59 by screw 60, the discharge opening of the spout can be adjusted. Adjustment of the opening results from the varied position of the cam and the manner in which the cam coacts with the lever 45.

Figure 5:
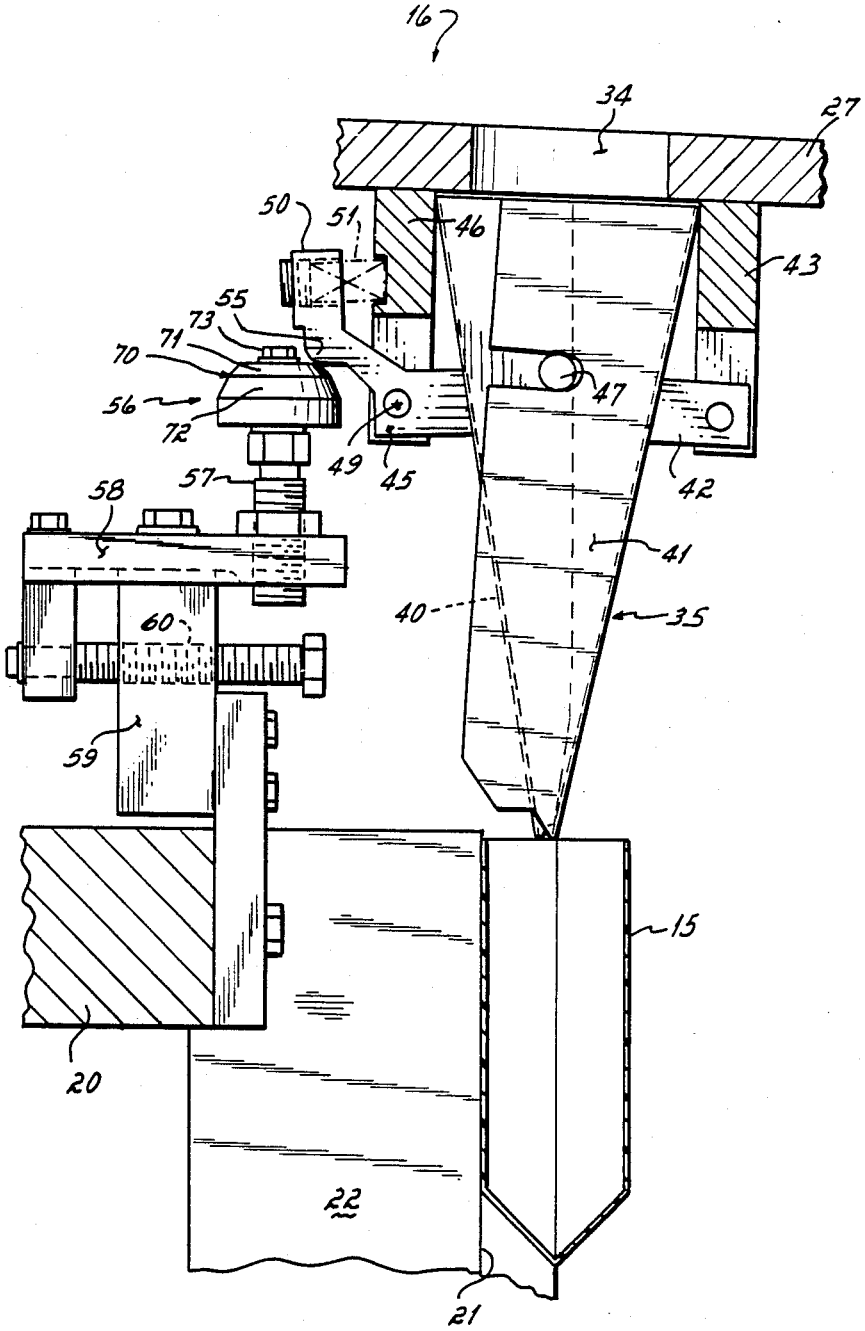
FIG. 5 is a cross-sectional view taken along lines 5—5 of FIG. 4.

Referring to FIG. 5, the cam 56 is circular in cross section and has an upper portion which is of a compound frusto-conical surface. The frusto-conical surface 70 has a upper section 71 that is steeply inclined to vertical and a lower section 72 that is more gradually inclined to vertical. The compound surface is to accommodate the fact that as the spout 35 and its cam follower 55 move downwardly because of the tilted spout plate 27, they also move radially out with respect to the center of the drum 20 because of the offset created by the inclined shaft 25 and because the spout must open after it enters the pouch and stay open during the filling operation.

Each cam 56 is preferably made of a plastic material such as Nylatron G.S., which has a lubricating agent. Each cam element is preferably machined from cylindrical stock. The upper section has an angle of about 45° to vertical and the lower section 72 has an angle of about 22° to vertical. The plastic material, with its lubricating agent, imposes minimum wear on the cam follower that engages it. Likewise, it tends to be quiet. When there is wear, the bolt 73 by which it is attached to its post 57 is loosened and the cam element is rotated through about 5° to bring an unworn surface in the path of the cam follower 55. When the cams are completely worn, they can obviously be changed at practically no expense.

In the operation of the invention, the assembly of drum, spout plate and metering wheel are rotated at around 20 to 30 rpm. Product from the hopper 39 is scraped into the cups 36. When the cups 36 pass over the arcuate sinuous slot 38 in the stationary plate 31, the charge of product passes from the cup 36 through the slot and into the spout 35.

Prior to the discharge of the product into the spout, the spout will have moved from its highest position viewed at the left side of FIG. 3 to its lowest position viewed at the right side of FIG. 3. As the spout descends toward a pouch 14, the lower ends of the jaws 40 and 41 are closed as shown on the left side of FIG. 3. In the closed attitude, the jaws enter a pouch. After entry into the pouch, the cam follower 55 engages the upper section 71 of the cam 56. The spout quickly opens, spreading the open end of the pouch. When the pouch is open, the cuff 37 begins to ride over the slot 38 in the stationary plate and product begins to flow through the spout into the pouch. During this time, the spout continues to descend because of the inclination of the spout plate 27. The cam follower 55 shifts to the lower section 72 of the cam which holds the spout jaws in the open attitude. After the pouch has been filled, the spout will begin to rise, easing itself out of the pouch until it once again swings to the position shown at the left side of FIG. 3, the vertical movement being the distance of about 1½inches.

Thus, it can be seen that the spout discharge opening has been small when entering the pouch, but, once into the pouch, expands in order to facilitate the flow of product into the pouch.

While the invention has been disclosed in conjunction with a volumetric metering wheel, it should be understood that the invention is applicable to other types of metering devices.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

We claim:

1. In a pouch-filling apparatus having a horizontal rotatable drum having a plurality of vertical lands defining pouch compartments for carrying a web of pouches to be filled, an inclined spout plate rotatably mounted above said drum and having filling holes aligned with said pouch compartments and a metering device mounted above said spout plate, means for rotating said drum and spout plate, the improvement comprising, a plurality of duck bill spouts mounted on the underside of said spout plate, each spout being aligned with a respective one of said filling holes, said spouts being carried upward and downward by said inclined spout plate as said plate is rotated, means for expanding and contracting the lower end of said spout, said means including, a cam follower mounted on each spout, a cam mounted on said drum adjacent each spout and engageable by said cam follower as said spout moves downward toward said drum during rotation of said inclined spout plate.

2. Pouch filling apparatus as in claim 1 in which each duck bill has an inner and outer jaw pivoted together, each jaw being pivoted to said spout plate, said cam follower being fixed to said inner jaw.

3. Pouch filling apparatus as in claim 1 in which said cam has an upper severely-inclined surface which, when engaged, expands said spout, and has a lower, gradually-inclined surface which holds said jaws open during the filling operation.

4. Pouch filling apparatus as in claim 1 in which said cam is a plastic element bolted to said drum.

5. Pouch filling apparatus as in claim 1, each cam comprising, a plastic element of circular cross section, a vertical post fixed to said drum for each plastic element, and a vertical bolt passing through said plastic element to secure said element against rotation on said post while permitting rotation upon loosening said bolt to bring an unworn surface in the path of said cam follower.

6. In a pouch-filling apparatus having a horizontal rotatable drum having a plurality of vertical lands defining pouch compartments for carrying a web of pouches to be filled, an inclined spout plate rotatably mounted above said drum and having filling holes aligned with said pouch compartments and a metering mounted above said spout plate, means for rotating said drum and spout plate, the improvement comprising, a plurality of spouts mounted on the underside of said spout plate, spout being aligned with a respective one of said filling holes, said spouts being carried upward and downward by said inclined spout plate as plate is rotated, each spout having an adjustable discharge opening, means for expanding and contracting the discharge opening of each said spout, said means including, a cam follower mounted on each spout, a cam mounted on said drum adjacent each spout and engageable by said cam follower as said spout moves downward toward said drum during rotation of said inclined spout plate.

* * * * *